United States Patent [19]

Vincent et al.

[11] 4,418,769

[45] Dec. 6, 1983

[54] HAMMER STARTING MECHANISM

[75] Inventors: Robert R. Vincent, Denver; James T. Clemenson, Littleton, both of Colo.

[73] Assignee: Cooper Industries, Inc., Houston, Tex.

[21] Appl. No.: 243,076

[22] Filed: Mar. 12, 1981

[51] Int. Cl.[3] ..... B25D 9/04

[52] U.S. Cl. ..... 173/134; 91/234; 91/240

[58] Field of Search ..... 173/127, 134, DIG. 4; 91/232, 234, 240, 325

[56] References Cited

U.S. PATENT DOCUMENTS

| | | | |
|---|---|---|---|
| 1,401,003 | 12/1921 | Smith | 91/232 |
| 1,504,976 | 8/1924 | Ringle | 91/234 X |
| 1,554,776 | 9/1925 | Bayles | 91/240 |
| 1,573,457 | 2/1926 | Slaber | 173/134 X |
| 1,872,403 | 8/1932 | Cannon | 91/234 |
| 3,785,248 | 1/1974 | Bailey | 91/232 X |
| 3,879,018 | 4/1975 | Hunter | 91/234 X |
| 4,282,937 | 8/1981 | Hibbard | 173/134 X |

*Primary Examiner*—James J. Jones, Jr.
*Assistant Examiner*—Robert P. Olszewski
*Attorney, Agent, or Firm*—Spensley, Horn, Jubas & Lubitz

[57] ABSTRACT

A starting mechanism for a reciprocating piston pneumatic hammer provides a passageway coupling a pneumatic piston subchamber to an exit port to exhaust pressurized pneumatic fluid from the subchamber during a start-up period. A pneumatic valve is provided to open the passageway as the hammer is started so as to create a pressure differential in the coupled piston subchamber, and thus prevent the piston from centering. The valve closes the passageway after the piston reciprocation has begun.

7 Claims, 4 Drawing Figures

HAMMER STARTING MECHANISM

BACKGROUND OF THE INVENTION

Prior Art

The present invention relates to pneumatic hammers, and more particularly to pneumatic hammers having a reciprocating piston.

Pneumatic hammers typically utilize pressurized pneumatic fluids, such as pressurized air from an outside source, to drive a piston forward to impact a tool (such as a chisel) held within the hammer. Subsequently, pressurized pneumatic fluid drives the piston back to position the piston to again strike the tool. The piston reciprocates in this manner within a chamber of the hammer housing.

The piston typically divides the chamber into two subchambers, with one subchamber (often designated an "impact" subchamber) on one side of the piston and the other subchamber (or "retracting" subchamber) on the other side of the piston. Pressurized pneumatic fluid is supplied to the impact subchamber to drive the piston forward toward the tool. Generally, as the piston strikes the tool, pneumatic fluid is supplied to the retracting subchamber, thereby driving the piston back, while the pneumatic fluid within the impact chamber is allowed to exhaust through an exhaust port. Near the end of the piston's travel in the retracting direction, pneumatic fluid is resupplied to the impact subchamber and the pneumatic fluid within the retracting subchamber is allowed to exhaust, thus reversing the direction of the piston to again strike the tool. In this manner, a reciprocating motion of the piston is maintained.

A difficulty often encountered with pneumatic hammers is the tendency of the piston to "center" when attempting to start the hammer, especially when the hammer is held in a horizontal position. This problem occurs when the pneumatic hammer is unable to develop a sufficient pressure differential upon opposing faces of the piston dividing the impact and retracting subchambers during the start up phase. Consequently, the piston centers itself in the middle of the chamber and does not oscillate.

Prior attempts to alleviate the foregoing problem include devices such as that shown in U.S. Pat. No. 3,785,248 to Bailey, in which pneumatic fluid pressure above that which is utilized during oscillation is supplied to one of the subchambers in order to start the piston oscillating. However, the devices described therein requires an additional external conduit and external valve arrangement connecting the conduit to the pressurized fluid source to supply the additional pressurized fluid to the hammer. This can make a pneumatic hammer more difficult to connect to the source and more cumbersome to operate.

SUMMARY OF THE INVENTION

It is an object of the present invention to provide a hammer starting mechanism obviating, for practical purposes, the above-mentioned limitations, particularly in a manner requiring a relatively uncomplicated mechanical arrangement.

A preferred embodiment of the present invention provides a pneumatic fluid pressure actuated valve for use in a pneumatic hammer to prevent the hammer piston from centering during start-up. The valve has an inlet port operably connected to one of the hammer subchambers, an outlet port operably connected to a main exhaust port, and an actuation inlet port operably connected to the source of pressurized pneumatic fluid. The valve has an open position in which a hammer subchamber is connected to the main exhaust port during the starting of the hammer. The valve is closable by pressurized pneumatic fluid entering the actuation inlet port of the valve.

Accordingly, pressurized pneumatic fluid may be supplied to the impact and retracting subchambers of the hammer to start the hammer operation with the pneumatic fluid in one of the subchambers being exhausted through the open valve to the main exhaust port, resulting in a pressure differential between the two hammer subchambers. As a result the piston is caused to move. Meanwhile, pneumatic fluid in the hammer is also supplied to the valve actuation inlet port, which subsequently causes the valve to close. Thus, the piston of the hammer is prevented from centering within the chamber. Furthermore, the closed value prevents pneumatic pressure from escaping during operation which may result in a loss of power.

These and other advantages will become more apparent in the following detailed description and accompanying drawings.

BRIEF DESCRIPTION OF THE DRAWINGS

Like numbers in the different figures refer to like elements.

DETAILED DESCRIPTION OF THE DRAWINGS

Figure 1:
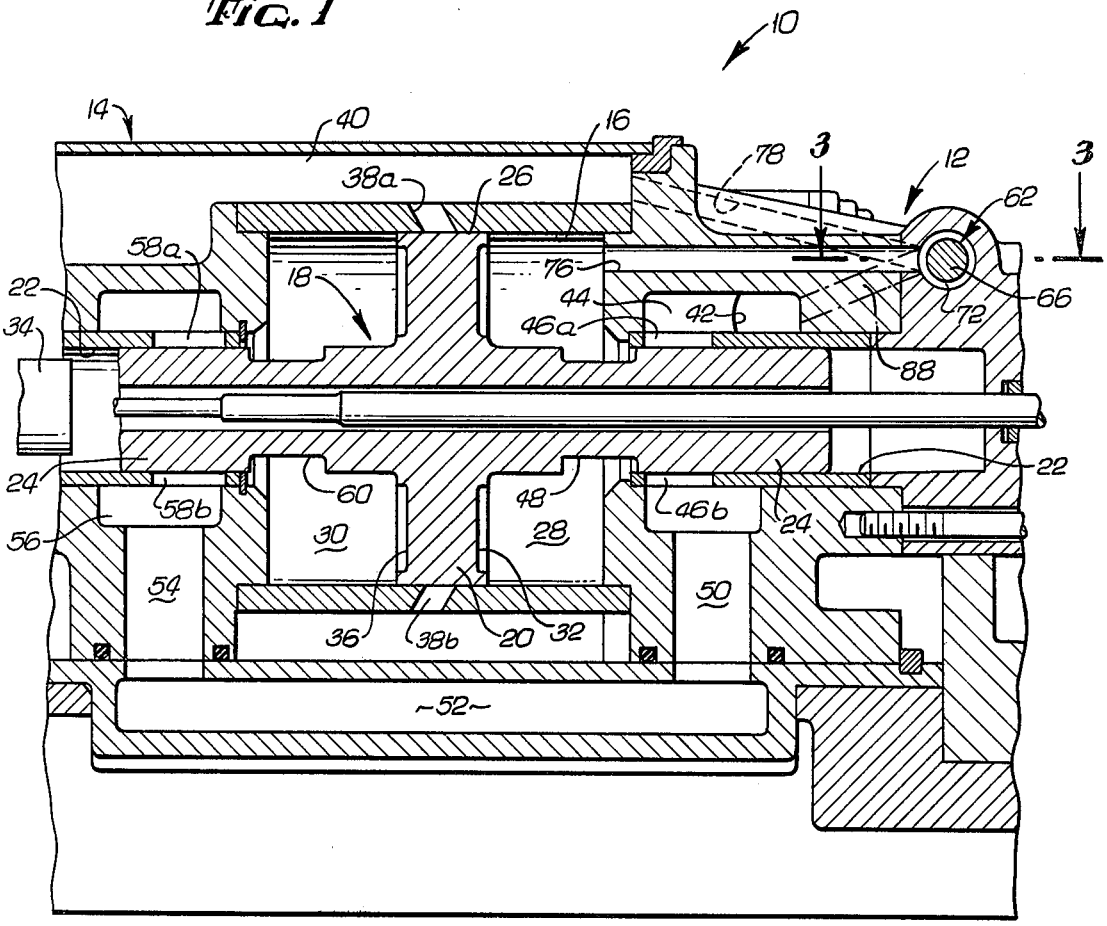
FIG. 1 is a partial cross-sectional view of a pneumatic hammer according to a preferred embodiment of the present invention and illustrating the piston of the hammer in an intermediate position.

With reference to FIG. 1, a pneumatic hammer 10 is shown utilizing the hammer starting mechanism of the present invention, which is indicated generally at 12. The hammer 10 comprises a housing 14 which has a chamber 16. A piston 18 has a flange portion 20 which is slidably carried within the chamber 16. The housing 14 has a bore 22 smaller than and coaxial with the chamber 16, which carries a rod portion 24 of the piston 18. The piston 18 slides back and forth within the chamber 16 and bore 22, with the outside wall 26 of the flange portion 20 making a substantially fluid-tight slidable seal with the interior wall of the chamber 16.

The piston 18 divides the chamber 16 into two subchambers 28 and 30. The subchamber 28 is defined by a rearward wall 32 of the flange portion 20, the rod portion 24 of the piston 18, and the interior walls of the chamber 16. The subchamber 28 is designated an "impact" subchamber since when pressurized pneumatic fluid (such as pressurized air in the illustrated embodiment) is introduced into the subchamber 28, the piston 18 is driven to the left as seen in FIG. 1 until the rod portion 24 of the piston 18 impacts the shank of a tool 34.

The other subchamber 30 of the chamber 16 is defined by a foward face 36 of the flange portion 20, the rod portion 24 and the interior walls of the chamber 16, and is designated a "retracting" subchamber. Upon striking the tool 34, pressurized air is introduced into the retracting subchamber 30 which drives the piston 18 away from the tool 34 and to the right as seen in FIG. 1. Upon reaching a particular point, the piston 18 is then driven back to the left by pressurized air introduced to the subchamber 28. The piston 18 continues back and forth in a reciprocating motion, repeatedly striking or impacting the tool 34.

Exhaust ports 38*a* and 38*b* are provided to exhaust the air from one subchamber as the other subchamber is being pressurized, thereby permitting a pressure differential to be developed on the flange portion faces 32 and 36 and allowing the piston 18 to be driven in one direction or the other. The exhaust ports 38*a* and 38*b* open out into an exhaust muffler chamber 40 which in turn is connected to a main exhaust port (not shown) through which the air in the exhaust chamber 40 exits to the outside of the housing 14.

As can be seen in FIG. 1, there is a range of intermediate positions between the limits of the piston's travel in which the exhaust ports 38*a* and 38*b* are covered by the flange portion 20 of the piston 18. When the piston is in these intermediate positions, neither subchamber 28 nor 30 is in communication with the exhaust ports 38*a* and 38*b*. If it is attempted to start the hammer in a substantially horizontal position with the piston 18 in such an intermediate position, both subchambers 28 and 30 will be equally pressurized by air leaking into them around the hammer rod portion 24, which can result in an insufficient net force acting upon the piston 18. Thus, the piston 18 is centered in an intermediate position and is prevented from oscillating.

The same result can obtain with the piston 18 initially displaced from the intermediate positions. For example, if the initial position of the piston 18 is at the extreme left, the impact subchamber 28 is open to the outside through exhaust ports 38*a* and 38*b*. Thus, when the hammer is activated only the retracting subchamber 30 will be pressurized, causing the piston 18 to move to the right. However, as soon as the piston 18 travels sufficiently far to the rght to cover and block the exhaust ports 38*a* and 38*b*, the impact subchamber 28 will begin to pressurize and the piston 18 may not have sufficient momentum to overcome the pressure in the impact subchamber 28. Thus, the piston 18 can again stop or center at an intermediate position. Moreover, the problem of the piston centering can occur when the hammer is started in any position. Cold or non-circulating lubricants, or impurities within the lubricant or related problems, can affect the starting of the piston oscillation.

The hammer starting mechanism 12 of the present invention is designed to connect the impact subchamber 28 to the exhaust chamber 40 during a start-up period, to prevent the impact subchamber 28 from pressurizing for a short period of time while the retracting subchamber 30 is pressurizing, thereby allowing the piston 18 to begin oscillating, as will be more fully discussed below.

Pressurized air is supplied from an outside source (not shown) through an external conduit to a channel 42 within the housing 14 when the hammer is activated. The channel 42 opens up into a channel 44 which communicates with the bore 22 through inlet ports 46*a* and 46*b*. The rod portion 24 of the piston 18 has an annular groove 48 which, when aligned with the inlet ports 46*a* and 46*b* by the retracting motion of the piston 18 to the right, provides an open passageway for pressurized air from the inlet ports 46*a* and 46*b* to the impact subchamber 28. During oscillation, pressurizing the subchamber 28 causes the piston 18 to reverse its direction of travel and move to the left to impact the tool 34.

Pressurized air in the annular channel 44 is also conducted by a radial channel 50 outward to an axial channel 52. The pressurized air is then conducted inward by a radial channel 54 from the channel 52 to a second channel 56, which communicates with the bore 22 through inlet ports 58*a* and 58*b*. The rod portion 24 of the piston 18 has a second annular groove 60 which, when aligned with the inlet ports 58*a* and 58*b* by the impacting motion of the piston 18 to the left, allows pressurized air to be conducted into the retracting subchamber 30 to pressurize that subchamber.

Figure 2:
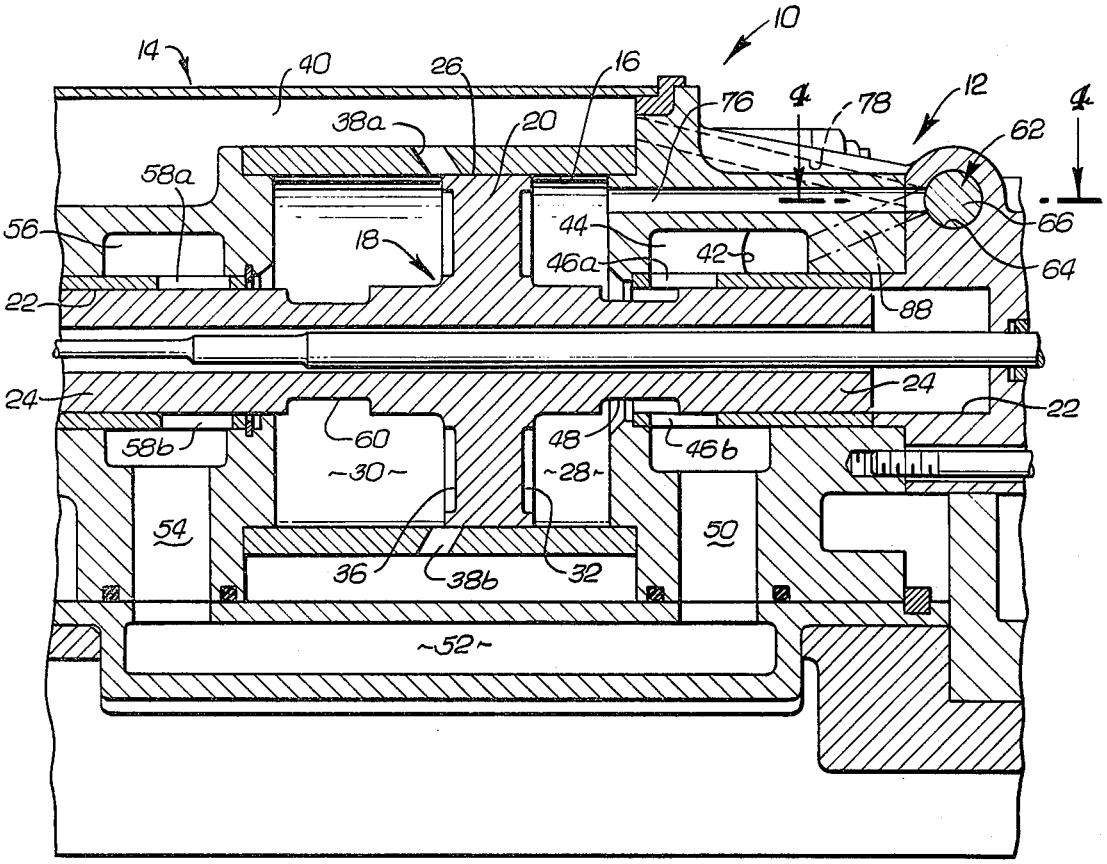
FIG. 2 is a partial cross-sectional view of the hammer of FIG. 1 illustrating the piston leaving the intermediate position.

During the impacting phase of normal piston oscillation, the face 32 of the flange portion 20 of the piston 18 moves past the exhaust ports 38*a* and 38*b*, thereby allowing the pressurized air within the impacting subchamber 28 to be exhausted through the exhaust ports 38*a* and 38*b*. After the piston 18 strikes the tool 34, the retracting subchamber 30 is in open communication with the input ports 58*a* and 58*b* through the groove 60 of the rod portion 24. Pressurized air is thus introduced within the retracting subchamber 30, and the piston is driven back to the right until the pressurized air within the retracting subchamber 30 in turn exhausts through the exhaust ports 38*a* and 38*b*. At that time, the impact subchamber 28 is in open communication with the ports 46*a* and 46*b* through the groove 48 of the rod portion 24, allowing the impact subchamber to repressurize to maintain the piston oscillation, as shown in FIG. 2.

Figure 3:
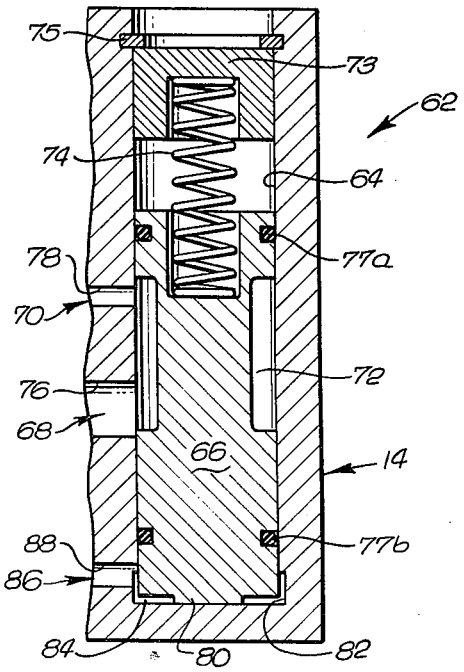
FIG. 3 is a partial cross-sectional view of a valve of the hammer of FIG. 1 along the line 3—3 illustrating the valve in an open position.

In order to eliminate the piston centering problem during start-up, the hammer 10 is provided with the hammer starting mechanism 12 which comprises a sliding valve 62 in the illustrated embodiment. As best seen in FIG. 3, the housing 14 has a cylindrical chamber 64 in which a cylindrical valve stem or piston 66 of the valve 62 is slidably carried. The valve breather chamber 64 is restricted at one end by a plug 73 which is secured in place by a retainer ring 75. A spring 74 interposed between one end of the valve piston 66 and the plug 73 urges the valve piston 66 into the open position shown in FIG. 3. The valve 62 has a pair of O-rings 77*a* and 77*b* which provide air-tight slidable seal between the valve piston 66 and the walls of the valve chamber 64. The valve 62 has an inlet port 68 and an outlet port 70 in one wall of the valve chamber 64. The valve piston 66 has a conduit or annular groove 72 through which the inlet port 68 can communicate with the outlet port 70. The inlet port 68 is coupled by a passageway 76 to the impact subchamber 28 (as best seen in FIG. 1), and the outlet port 70 is coupled by a passageway 78 to the exhaust chamber 40 of the housing 14.

When the hammer 10 is activated, any pressurized air entering the impact subchamber 28 is conducted from the subchamber 28 through the passageway 76 to the inlet port 68, through the annular groove 72 of the open valve 62 to the outlet port 70, and thence through the passageway 78 to the exhaust chamber 40. In this manner, with air pressurizing the retracting subchamber 30 and any air entering the impact subchamber 28 being exhausted through the open valve 62, a pressure differential between the two subchambers 28 and 30 exerts a net force on the piston flange portion 20, causing the piston 18 to move in a retracting motion to the right (as seen in FIG. 1) without centering.

Figure 4:
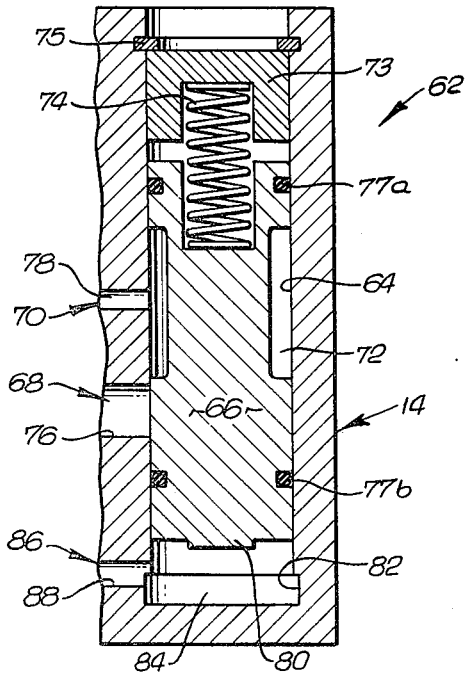
FIG. 4 is a partial cross-sectional view of the valve of FIG. 2 along the line 4—4 illustrating the valve in a closed position.

Referring further to FIG. 3, at the end of the valve piston 66 opposite the end to which the spring 74 is attached is a protrusion 80. The valve chamber 64 has an annular groove 82 which, along with the protrusion 80, defines a subchamber 84 of the chamber 64. The valve 62 has a second inlet port 86 which connects the valve subchamber 84 to the pressurized air channel 42 through a passageway 88 (FIG. 1). When pressurized air is supplied to the piston subchamber 28 and 30 to activate the hammer 10, pressurized air also enters the valve subchamber 84 through the passageway 88 and inlet port 86. The pressure in the valve subchamber 84 moves the valve piston 66 to the "closed position" compressing the spring 74. This moves the annular groove 72 away from the inlet port 68 (as shown in FIG. 4), which cuts off the passageway 76 (coupled to the impact subchamber 28) from the passageway 78 (coupled to the exhaust chamber 40). In this manner, pressurized air entering the valve subchamber 84 actuates the valve to the closed position, thereby allowing the impact subchamber 28 to be fully pressurized when the piston 18 reaches the position shown in FIG. 2. As long as pressurized air is supplied to the air channel 42 to operate the hammer 10, pressurized air within the subchamber 84 will push the valve piston 66 against the force exerted by the spring 74, thereby maintaining the valve 62 in the closed position.

It should be noted that the air actuation of the valve 62 provides an inherent delay before the valve 62 closes, which provides time for the piston 18 to build up sufficient momentum to begin oscillation before the impact subchamber 28 is allowed to fully pressurize. The time delay for the closing of the value 62 may be controlled by varying the compression resistance of the spring 74.

In summary, as pressurized air is initially supplied to activate the hammer 10, the retracting subchamber 40 is pressurized while the impact subchamber 28 is prevented from pressurizing because of the valve 62, which is held open under the urging of the spring 74. As a result, the piston 18 begins its retracting motion. In the meantime, pressurized air is also conducted to the valve subchamber 84, which pushes the valve piston 66 towards the closed position, as shown in FIG. 4. The pressure in the retracting subchamber 30 continues until the impacting subchamber 28 is in open communication with the inlet ports **46*a* and 46*b*, and grove 48, which allow the pressurized air to act on the flange of the piston 20, thereby starting piston oscillation. Since the valve 62 is closed by this time, the impact chamber 28** will contain maximum operating pressure.

Disconnecting the pressurized air from the hammer 10 will cause the piston 18 oscillations to stop and will allow the valve piston 66 to return to the open position under the urging of the spring 74. The hammer starter mechanism 12 is then ready for the next time the hammer 10 is to be activated.

As can be seen from the foregoing, a simple, reliable pneumatic hammer starting mechanism is provided which insures that the piston will begin oscillations regardless of the position in which the hammer is started. Furthermore, a hammer starting mechanism in accordance with the present invention does not require an additional source of pneumatic pressure or additional external conduits and the like.

It will, of course, be understood that modifications of the present invention, in its various aspects, will be apparent to those skilled in the art, some being apparent only after study and others being merely matters of routine mechanical design. For example, the starting mechanism valve may connect the retracting subchamber rather than the impact subchamber to the exhaust housing at the initiation of operation. Also, it is recognized that other types of valves may be used in the starting mechanism such as rotary valves and the like. Furthermore, it is seen that other means for actuating the valve may be used such as manual actuators. As such, the scope of the invention should not be limited by the particular embodiment and specific construction herein described but should be defined only by the appended claims and equivalents thereof.

Various features of the invention are set forth in the following claims.

I claim:

1. In a pneumatic hammer for repeatedly impacting a tool, said hammer having a housing which defines a chamber, a piston reciprocably carried within the chamber, said piston defining an impact subchamber of the chamber wherein pneumatic fluid supplied under pressure to the impact subchamber from an outside source drives the piston to impact the tool, the piston also defining a retracting subchamber of the chamber wherein pneumatic fluid supplied under pressure to the retracting subchamber drives the piston back from the tool, an exhaust port in the housing which provides an outlet from the chamber, said piston having a first position wherein the exhaust port is coupled to the impact subchamber so as to exhaust pneumatic fluid under pressure from the impact subchamber, a second position wherein the exhaust port is coupled to the retracting subchamber so as to exhaust pneumatic fluid under pressure from the retracting subchamber, and a third position intermediate the first and second positions in which the exhaust port is uncoupled from both subchambers, the improvement comprising:

a passageway located in the housing operably connecting one of the subchambers to an external outlet;

a valve located in the passageway, said valve having an open position in which said one subchamber is coupled through the open valve to the external outlet and a closed position in which the passageway is closed off;

means for biasing the valve in the open position at the start of the hammer operation wherein pneumatic fluid may be exhausted from said one subchamber to prevent the piston from centering in the intermediate position; and means for moving the valve from the open position to the closed position after the piston has started moving, said valve remaining in the closed position while the hammer is in operation.

2. The hammer of claim 1 wherein the valve comprises a second chamber located in the housing, and a body slidably carried within the second chamber, said body having a conduit and being movable within the second chamber such that the conduit is positioned in registration with the inlet and outlet of the valve to define the valve open position, said body being movable within the second chamber to move the conduit out of registration with the inlet and outlet to thereby close the valve.

3. The system of claim 2 wherein the valve body defines a subchamber of the second chamber and the means for moving includes a second passageway located in the housing coupling the valve subchamber to the source of pneumatic fluid, wherein pneumatic fluid supplied under pressure to the valve subchamber drives the valve body from the valve open position to the valve closed position after the piston has started moving.

4. The system of claim 3 wherein the means for biasing comprises a spring operably connected to the valve body wherein the application of pneumatic fluid under pressure will overcome the force of the spring and move the body to the closed position.

5. In a pressurized air hammer for repeatedly impacting a tool, said hammer having a housing which defines a chamber with a piston reciprocably carried within the chamber, said piston defining an impact subchamber of the chamber wherein pressurized air supplied to the impact subchamber from an outside source drives the piston to impact the tool and the piston also defining a retracting subchamber of the chamber wherein pressurized air supplied to the retracting subchamber drives the piston back from the tool, said piston having a first position wherein the impacting subchamber is operably connected to an exhaust port to exhaust air from the impacting subchamber, a second position wherein the retracting subchamber is operably connected to the exhaust port and a third position intermediate the first and second positions in which neither of the subchambers is connected to the exhaust port during operation of the hammer, the improvement comprising:

a valve having an inlet port and an outlet port, said valve including a portion of the housing which has a cylindrical chamber and a cylindrical valve stem slidably carried within the chamber, said valve stem having an annular groove through which the inlet port communicates with the outlet port with the stem in an open position, said valve stem defining a subchamber of the valve chamber and also being movable from the open position to disconnect the inlet port from the outlet port to define a closed valve position;

said valve further including a spring to bias the valve stem in the open position at the start of the hammer operation;

said housing having a first passageway operably connecting the inlet port to a piston subchamber, a second passageway operably connecting the outlet port to the exhaust port and a third passageway operably connecting the valve subchamber to the source of pressurized air wherein pressurized air may be supplied to the subchambers to start the air hammer operation with the air in one of the piston subchambers being exhausted through the open valve to the exhaust port causing a pressure differential in the two piston subchambers causing the piston to move and the air supplied to the valve subchamber causing the valve stem to move from the open position to the closed position after the piston has starting moving, said valve stem remaining in the closed position while the hammer is in operation.

6. In a pressurized air hammer for repeatedly impacting a tool, said hammer having a housing which defines a chamber with a piston reciprocably carried within the chamber, said piston defining an impact subchamber of the chamber wherein pressurized air is supplied to the impact subchamber from an outside source drives the piston to impact the tool and the piston also defining a retracting subchamber of the chamber wherein pressurized air supplied to the retracting subchamber drives the piston back from the tool, said piston having a first position wherein the impact subchamber is operably connected to an exhaust port to exhaust air from the impact subchamber, a second position wherein the retracting subchamber is operably connected to the exhaust port and a third position intermediate the first and second positions in which neither of the subchambers is connected to the exhaust port during operation of the hammer, the improvement comprising:

valve means having an inlet operably connected to a piston subchamber, an outlet port operably connected to the exhaust port and an actuator inlet port operably connected to the source of pressurized air, said valve means for operably connecting a piston subchamber to the exhaust port in a valve open position when the pressurized air is supplied to the hammer, said valve being closable by the pressurized air entering the actuator inlet port wherein pressurized air may be supplied to the subchambers to start the air hammer operation with the air in one of the piston subchambers being exhausted through the open valve to the exhaust port causing a pressure differential in the two piston subchambers which causes the piston to move and the air supplied to the valve actuation inlet causes the valve to move from the open position to the closed position after the piston has started moving so that the valve remains closed while the pressurized air is present.

7. A pneumatic air hammer comprising:

a housing including a central chamber therein;

a piston reciprocably carried within the chamber, said piston separating the chamer into an impact subchamber and a retracting subchamber;

a rod connected to the piston and extending out of the chamber substantially coaxial with the chamber;

means for supplying pressurized fluid to each of the subchambers;

an exit port located in the housing to enable pressurized fluid to escape from the chamber, wherein during operation of the hammer the piston will reciprocate so that said port will be sequentially coupled to the impact subchamber to permit fluid to escape therefrom, covered by the piston, and coupled to the retracting subchamber to permit fluid to escape therefrom;

a conduit, located in the housing and coupled to one of the subchambers, for enabling fluid under pressure to escape from said subchamber;

a valve for opening the conduit as the hammer is started and blocking the conduit after the hammer has been started, said valve and conduit enabling reciprocation of the piston to be started even if the exit port is covered by the piston;

means for biasing the valve to open the conduit at the start of the hammer operation wherein pneumatic fluid may be exhausted from said one subchamber to prevent the piston from centering; and means for moving the valve to block the conduit after the piston has started moving, said valve remaining in the blocking position while the hammer is in operation.

* * * * *